United States Patent [19]

Hazelett et al.

[11] 3,937,270

[45] Feb. 10, 1976

[54] TWIN-BELT CONTINUOUS CASTING METHOD PROVIDING CONTROL OF THE TEMPERATURE OPERATING CONDITIONS AT THE CASTING BELTS

[75] Inventors: Robert William Hazelett, Winooski; John Frederick Barry Wood, Burlington, both of Vt.

[73] Assignee: Hazelett Strip-Casting Corporation, Winooski, Vt.

[22] Filed: Nov. 9, 1973

[21] Appl. No.: 414,237

[52] U.S. Cl. ..... 164/50; 164/87; 164/121; 164/250; 164/278

[51] Int. Cl.[2] ..... B22D 11/06

[58] Field of Search ..... 164/50, 87, 121, 250, 278, 164/338 M

[56] References Cited

UNITED STATES PATENTS

| | | | |
|---|---|---|---|
| 1,651,678 | 12/1927 | Davis | 164/278 |
| 1,671,360 | 5/1928 | Fletcher | 164/278 |
| 2,904,860 | 9/1959 | Hazelett | 164/278 X |
| 3,426,836 | 2/1969 | Altenpohl et al. | 164/278 |

FOREIGN PATENTS OR APPLICATIONS

| | | | |
|---|---|---|---|
| 525,756 | 6/1956 | Canada | 164/278 |

*Primary Examiner*—Ronald J. Shore
*Attorney, Agent, or Firm*—Parmelee, Johnson & Bollinger

[57] ABSTRACT

Continuous casting methods are described wherein the temperature of the flexible casting belts in twin-belt machines having two or more main rolls in each belt carriage is controllably elevated prior to contact with the molten metal to improve the casting conditions and the operation of the thin flexible casting belts; the temperature elevation preferably being relatively gradual may be carried out while the travelling belts are approaching the nip rolls or while the belts are in contact with the nip rolls, or both. Zone control of belt pre-heating is disclosed, and control of the coolant streams issuing from the curved nip roll tubes by use of fingernail-like extenders may be provided to aid in pre-heating the belts and in controlling their operation. Intensive infra-red heaters are shown directed at close range toward the casting surfaces of the belts, these heaters serving also to cure and dry any coating material on the belts. Heating by means of hot fluid, such as steam, is described, with the hot fluid being directed into the deep grooves in the nip roll beneath the rear surfaces of the casting belts. Mechanical and thermal sensors may be employed to sense the distortion of the belts and to measure their operating temperatures, these sensors being shown with automatic control of the belt pre-heating action. The methods of the invention can be applied to twin-belt casting machines regardless of whether the molten metal is supplied by open pool, closed pool or injection feeding.

17 Claims, 21 Drawing Figures

TRANSVERSE BELT TEMPERATURE PROFILE
AMBIENT TEMPERATURE
93
94
92
LONGITUDINAL TENSION 63
16'

8B
73
32'
HOT CASTING REGION C
8A
TRANSVERSE BUCKLING 62
8B
72
63
64
8A

LONGITUDINAL BELT TEMPERATURE PROFILE
83
82
81
64
E
63
COLD REGION 71

TWIN-BELT CONTINUOUS CASTING METHOD PROVIDING CONTROL OF THE TEMPERATURE OPERATING CONDITIONS AT THE CASTING BELTS

DESCRIPTION

The present invention relates to continuous casting methods wherein the temperature of the flexible casting belt in twin-belt casting machines is controllably elevated prior to contact with the molten material being cast.

FIELD OF THE INVENTION

In twin-belt casting machines the material being cast, which is illustratively shown herein as molten metal, is fed into a casting region between opposed portions of a pair of revolving flexible metal belts. The moving belts confine the molten metal between them and carry the molten metal along as it solidifies between them. Spaced rollers having narrow ridges support and drive the belts and also guide the belts as they move along through the casting region. The vast quantities of heat liberated by the molten metal as it solidifies are withdrawn through the portions of the two belts which are adjacent to the metal being cast. This large amount of heat is withdrawn by cooling the reverse surfaces of the belts by means of rapidly moving substantially continuous films of liquid coolant travelling along against these reverse surfaces.

Each of the two flexible casting belts is revolved around a belt carriage in a path defined by main rolls located in the carriage and around which the belt passes. In some twin-belt casting machines there are two main rolls at opposite ends of the carriage defining an oval path for the belt to travel. In other twin-belt casting machines there are three or more main rolls in each carriage defining the belt path.

In some twin-belt casting machine installations the upper and lower casting belts converge directly opposite each other around opposed nip rolls to form the entrance to the casting region, and the molten metal is fed into the machine through a pouring spout extending into the entrance. This is often called an "injection feeding" technique. In other twin-belt casting machine installations the lower casting belt is arranged to support a pool of molten metal adjacent to the entrance between the upper and lower belts. This latter arrangement is called an "open pool" or "closed pool" casting technique, depending upon whether the surface of the molten pool is open to the atmosphere or is closed over by a protective barrier to exclude the atmosphere. Variations of these molten metal feeding techniques are sometimes employed, such as a partially open pool. However, as used herein, all of the various techniques for feeding molten metal into a twin-belt casting machine are intended to be included within the descriptive phrase: "open pool, closed pool or injection feeding".

The present invention can be employed to advantage in any of these various twin-belt casting machines whether using two, three, or more main rolls in each carriage, and the invention can also be employed to advantage regardless of whether the molten metal is being fed into the machine by an open pool, closed pool, or injection feeding.

For further information about twin-belt casting machines, the reader may refer to one or more of the following U.S. patents in the name of Clarence W. Hazelett or R. William Hazelett and Richard Hazelett: U.S. Pat. Nos. 2,640,235; 2,904,860; 3,036,348; 3,041,686; 3,123,874; 3,142,873; 3,167,830; 3,228,072; and 3,310,849.

PRIOR ART

In the prior art, efforts were made to minimize the heating effects of the molten metal on the casting belts of twin-belt machines. The high velocity liquid coolant was applied to the reverse surfaces of the belts a relatively long time before the molten metal came in contact with their front faces. Also, the high velocity liquid coolant was applied to the reverse surfaces of the belts a relatively great distance ahead of the point where the molten metal came in contact with their front faces.

In addition, relatively thick insulative coatings were often applied to the front faces of the flexible metal casting belts. It was these insulative coatings which were at the interface between the molten metal and the casting belts and served to reduce the rate of heat transfer from the molten metal into the belts.

Nevertheless, in the prior art, as the molten metal began to be carried along downstream with the belts near the entry to the casting region, momentary or permanent belt distortion could occur due to buckling resulting from thermal expansion, as explained in detail in connection with FIGS. 8, 8A and 8B. Efforts were made in the prior art to minimize any such distortion by applying high tension forces to the belts, and one or more of the main rolls were sometimes contoured slightly as by reverse crowning to counteract such distortion, as described and claimed in U.S. Pat. No. 3,123,874.

THE INVENTION

The invention provides continuous casting methods in which the temperature of the flexible casting belts in twin-belt casting machines is controllably elevated prior to contact with the material being cast, which is illustratively shown as molten metal. The casting belts may be elevated in temperature by various methods, as explained in connection with the various illustrative embodiments of the invention which are described.

In some embodiments of the invention, one or more banks of high intensity infra-red heaters may be directed at close range against the front faces of the casting belts to elevate their temperature before the belts come into contact with the molten metal. The banks of infra-red heaters may be arranged to heat the casting belts before they reach the nip rolls at the entrance to the casting region or during travel of the belts around the nip rolls or both before and during travel around the nip rolls.

In further embodiments of the invention, the high velocity liquid coolant may be directed onto the reverse surfaces of the casting belts, so that this cooling effect occurs only momentarily before or simultaneously with the contact of the molten metal against the casting belts. Special fingernail-like extensions are shown attached to liquid coolant nozzles nested within deep grooves in the nip rolls.

These fingernail extenders mask off the coolant streams from the reverse surface of the casting belt and spread out the coolant streams to form a sharply defined coolant layer. This sharply defined coolant layer enables the cooling action to be precisely started by application to the reverse surface of the casting belt very near to the point where the molten metal approaches the front surface of the casting belt. The cooling effect of the liquid coolant in conjunction with the nip roll may be controlled by insulating the deep grooves in the nip roll or by insulating the narrow ridges between these grooves.

Hot fluid, such as steam, may be directed into the deep grooves of the nip roll beneath the casting belts to aid in elevating and controlling their temperature.

Mechanical and thermal sensors may be employed to sense any distortion in the casting belts near the entry to the casting region and to monitor the belt temperature, and the elevation of the temperature of the casting belts ahead of the casting region is controlled to optimize the casting conditions as determined by these sensors.

Various zones of heating may be provided, so that the temperature of the main central area of the casting belts is controllably elevated independently of the edge portions of the belts and vice versa.

A number of advantages and benefits, as indicated hereinafter, are provided by employing the invention in twin-belt casting machines:

1. Casting belt distortion and transverse buckling along the casting region near and downstream from the entry of the molten metal due to differential transverse thermal expansion is markedly reduced and often is completely overcome.

2. Thermal shock to the belt and to the insulating coating on the belt due to contact of the molten metal at the entry to the casting region are markedly reduced because the temperature of the insulative coating and belt are gradually elevated before contact with the molten metal occurs. The operating lives of the belt and its coating are thereby increased.

3. Reduction in differential temperatures and resultant reduction in belt stresses enhances belt life and operating conditions in the machine.

4. The belt coating may be dried or cured to achieve more consistent thermal resistance or other desired characteristic such as absolute minimizing of moisture content before contact with the molten metal.

5. The provision of mechanical probes to sense the belt shape and thermal probes to sense the temperature profile enables overall precise control of the twin-belt casting operation to be obtained.

6. By virtue of the minimization or elimination of differential or non-uniform thermal expansion and distortion or buckling effects, lighter or simpler or thinner or more durable belt coatings with less insulating value (lower thermal resistance) can be utilized. These result in savings in belt fabrication time and material costs and also extend the operating lives of belts and coatings to provide operational savings.

7. Because coatings of less insulative value can be employed, the effective rate of cooling of the material being cast is accelerated, and consequently faster casting rates can be used in such cases, i.e. the tonnage output of the casting machine per hour can be increased.

8. The control belt flatness and thermal factors at the entry to the casting region and downstream from the entry enable improved metallurgical behavior to be achieved.

9. By minimizing or eliminating belt distortion, the thin cast shell which initially forms from the molten metal adjacent to the belt is stabilized. Localized variable heat transfer rates are avoided because the casting belt does not distort but rather it remains stable in position against the thin cast metal shell being formed. Thus, more uniform metallurgical properties can be attained, a more consistent cast shape is provided, and more consistent surface appearance is obtained over the top and bottom surfaces of the cast product.

10. More difficult or more critical alloys can be cast with greater commercial suitability in twin-belt machines.

11. Thinner sections of metal alloys of acceptable quality and sound structure are enabled to be cast in twin-belt machines employing the invention.

12. By minimizing or eliminating belt distortion and by controlling the temperature conditions a more uniform feed rate of molten metal into the casting machine can be attained for all types of metal feeding, because the volume of the casting region remains more constant and the shrinkage of the metal being cast is more nearly constant.

The various additional features, advantages and objects of the present invention will become more fully understood from a consideration of the following detailed description in conjunction with the accompanying drawings.

BRIEF DESCRIPTION OF THE DRAWINGS

FIG. 12 is intended to be compared with FIG. 11, because FIG. 12 illustrates the advantageous action of the fingernail extenders in cooperation with the curved coolant tubes nested between the ridges of the nip roll for controlling the application of the coolant to the belt;

FIG. 13A shows a curve similar to the curve shown in FIG. 9A;

DETAILED DESCRIPTION

Figure 1:
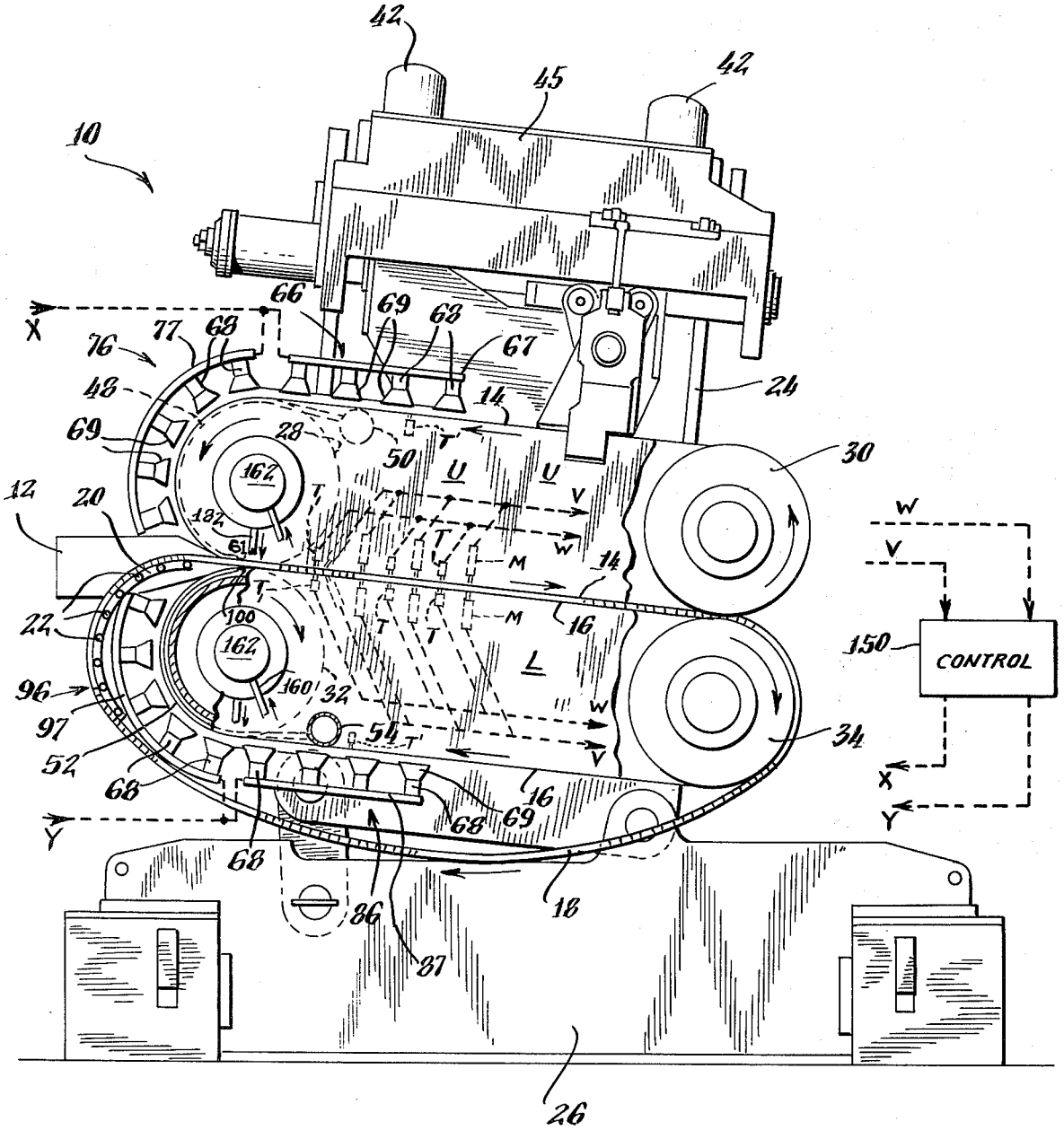
FIG. 1 is an elevational view of the outboard side of a continuous casting machine of the twin-belt type embodying the present invention.
Figure 2:
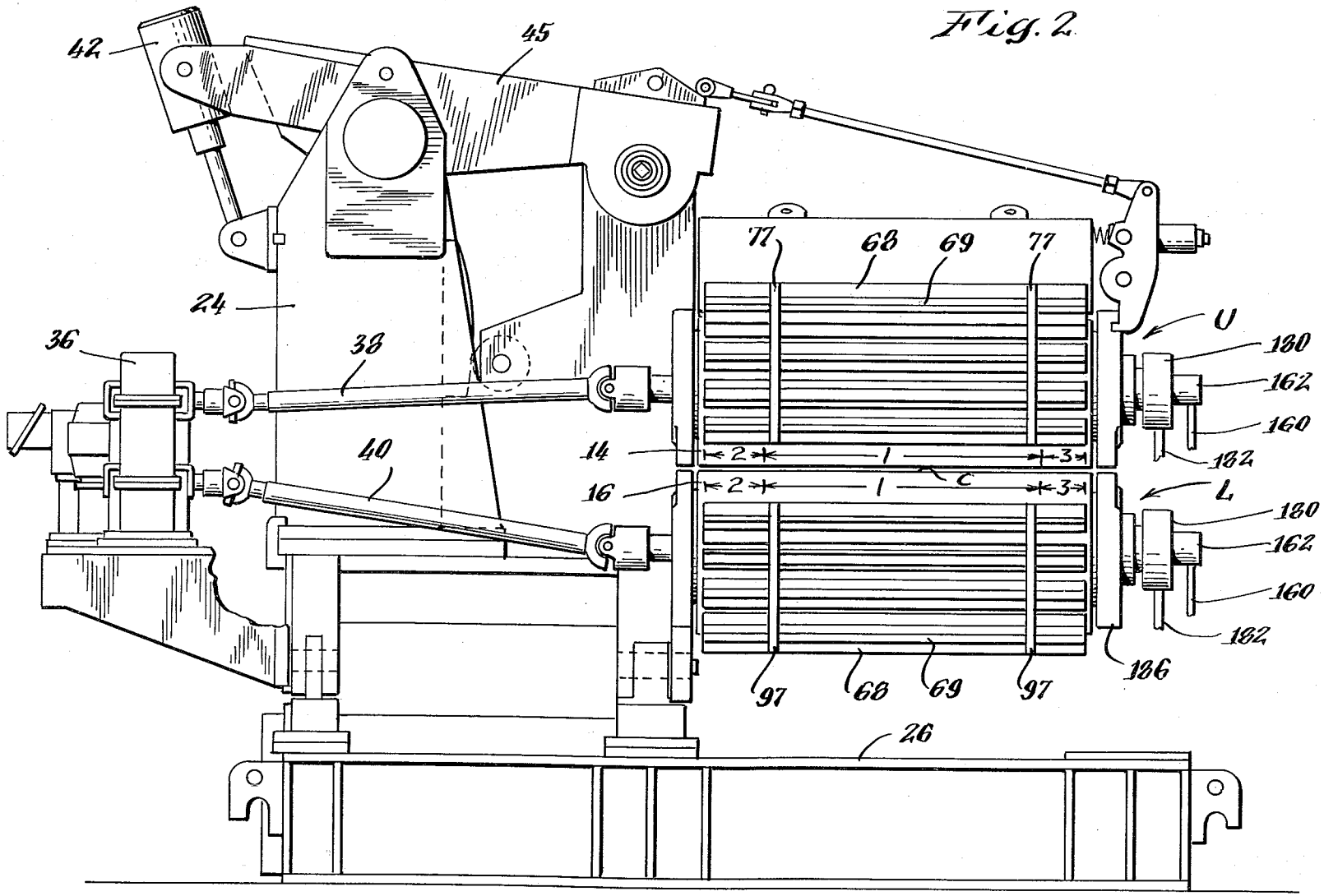
FIG. 2 is an elevational view of the input end of the machine of FIG. 1.

In the continuous casting machine 10 shown in FIGS. 1 and 2, the molten metal is introduced from a tundish 12 located at the input end of the machine. The molten metal passes into and is solidified in a casting region C defined between the spaced parallel surfaces of a pair of wide endless flexible casting belts 14 and 16. In operation, these belts are revolved around an upper and a lower belt carriage U and L, respectively. The two sides or edges of the casting region C are defined by a pair of laterally separated flexible endless side dams 18, which travel between the upper and lower casting belts in the casting region and which revolve around the lower carriage L to complete their circuit of travel. An arcuate guide 20 carrying multiple small pulley wheels 22 serves to guide each of the side dams as it moved into the entrance to the casting region. Only one of the side dams 18 and only one of the arcuate guides 20 can be seen in FIG. 1.

In FIG. 2, the tundish 12, side dams 18 and arcuate guides 20 have been omitted for clarity of illustration.

The carriages U and L of the upper and lower belt are supported from the back 24 of the machine 10 mounted on a base 26. The upper belt carriage U includes a pair of main rolls 28 and 30 located at the upstream and downstream ends of this carriage. Similarly, the lower belt carriage L includes a pair of main rolls 32 and 34 at its upstream and downstream ends.

In the machine 10, the downstream rolls 30 and 34 serve to tension and to steer the respective belts on their carriages. The type of twin-belt machine shown in FIGS. 1 and 2 is sometimes called a "two roll" or "two pulley" machine because there are two main rolls on each of the carriages. The upstream rolls 28 and 32 define the entrance or nip portion of the casting region and are used to drive the belts on the respective carriages. For convenience, these rolls 28 and 32 will be referred to as the "nip" rolls. The power mechanism 36 for driving the nip rolls is shown in FIG. 2 with universal coupled drive shafts 38 and 40 extending from the power mechanism to the nip rolls. A pair of lift cylinders 42 acting through a lever system 45 serve to raise the whole upper carriage when it is desired to open up the casting region C or to change the thickness of the product to be cast.

As the upper casting belt 14 is revolved, it moves in an oval counterclockwise path as seen in FIG. 1. This belt travels from the top of the downstream roll 30 to the left over to the top of the nip roll 28 and then curves 180° in passing down around the upper nip roll into the entrance to the casting region and moves toward the right along the casting region C to the bottom of the downstream roll 30 and then curves 180° in passing up around this downstream roll. Similarly, as the lower casting belt 16 is revolved, it moves in an oval clockwise direction as seen in FIG. 1. It curves 180° in passing up around the lower nip roll 32 into the entrance to the casting region and again curves 180° in passing down around the downstream roll 34 where it begins its return trip to the nip roll.

The outer surface of each casting belt which faces the casting region (see also FIG. 3) is called the "front" face F. The surface facing inwardly toward the main rolls is called the "reverse" or "back" face R of the belt. The belts are made of relatively thin sheet steel, and the front face often has a finely roughened texture produced by sand blasting. A coating of thermal insulation material is often adhered to this roughened surface.

The reverse surfaces of each belt are cooled by high velocity layers of liquid coolant, usually water, forcefully propelled along these surfaces. An intense coolant flow is employed usually amounting to thousands of gallons per minute to remove the large amount of heat being released as the molten metal is solidifying.

In order to initiate these high velocity layers 43 (FIG. 3) of coolant, the nip rolls 28 and 32 are formed with multiple closely adjacent deep grooves 44 (as seen most clearly in FIGS. 3, 4 and 5) defining relatively narrow fins 46 between neighboring grooves. A plurality of curved wrap-around coolant tubes 48 and 52 having an oval cross section are nested in the respective grooves of the nip rolls 28 and 32. As seen in FIG. 1, large diameter header pipes 50 and 54 are rigidly secured to the respective coolant tubes 48 and 52 and feed coolant into these curved tubes. These curved tubes 48 and 52 have been formed essentially to the same radius as the associated nip pulley and are cantilevered from the large rigid header pipes 50 and 54, respectively.

Figure 3:
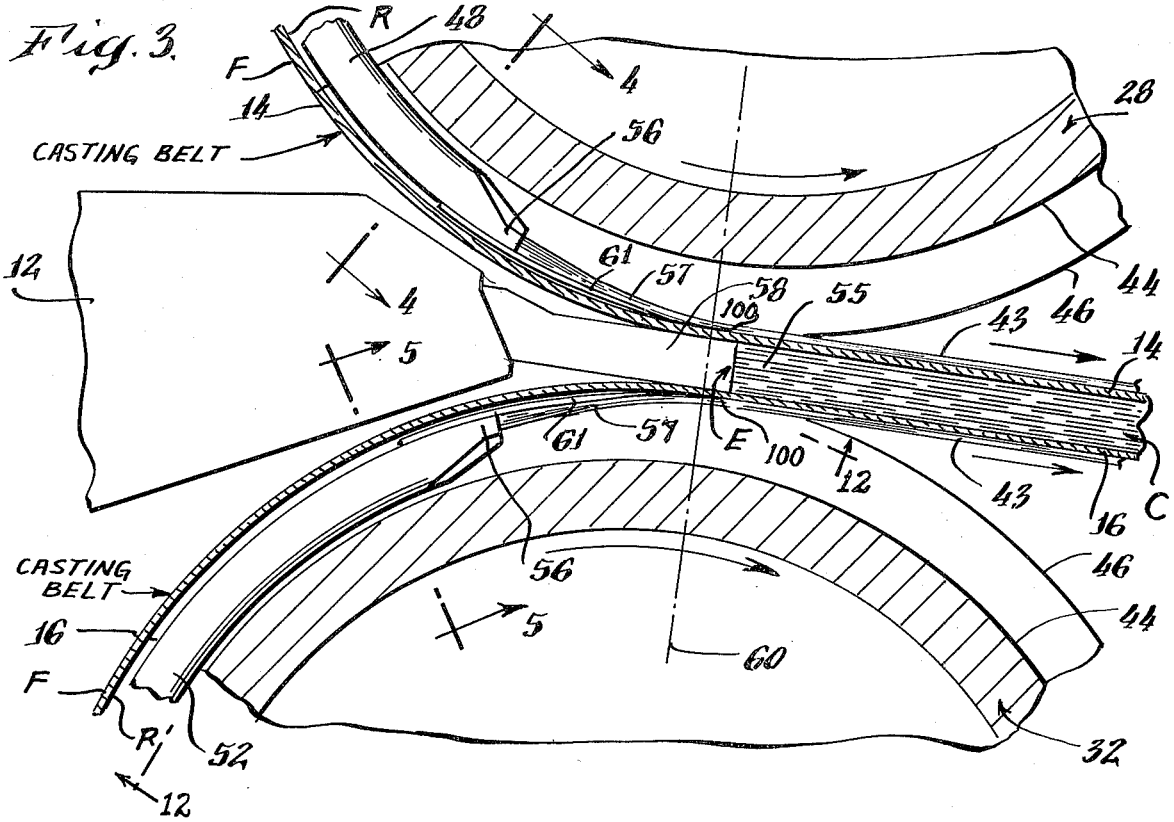
FIG. 3 is an enlarged partial sectional view showing the entrance to the casting region in detail.
Figure 4:
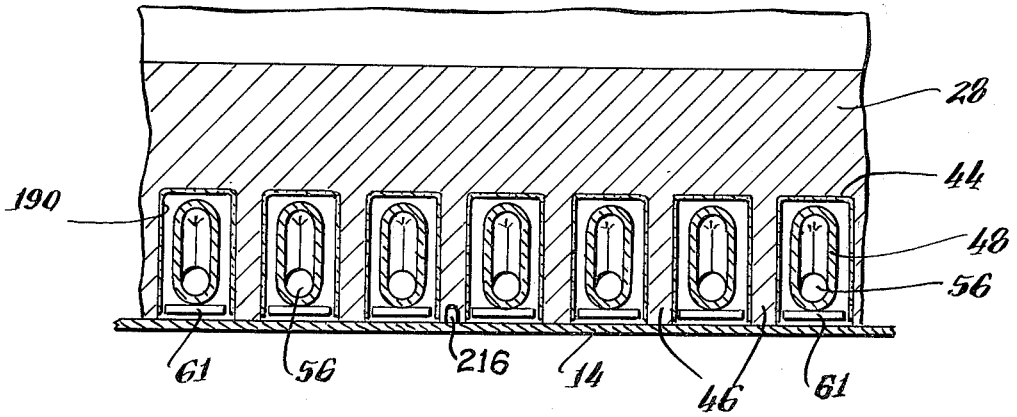
FIGS. 4 and 5 are sectional views taken along the planes 4—4 and 5—5 in FIG. 3 and shown further enlarged.
Figure 5:
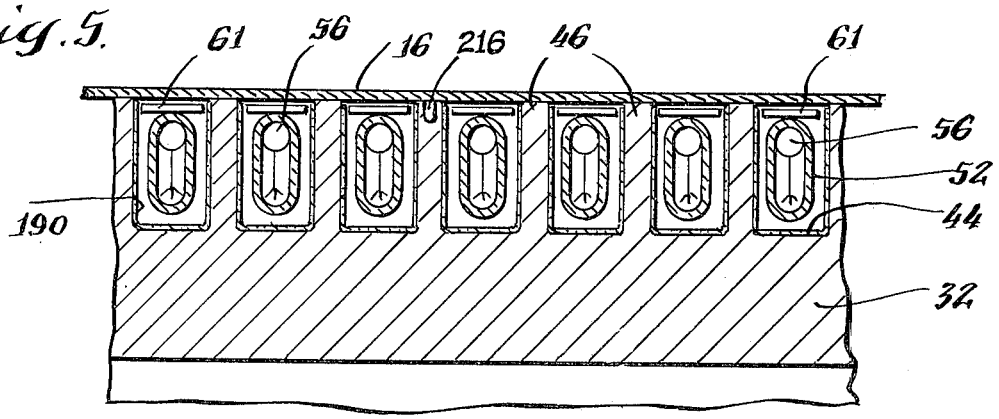
Figure 6:
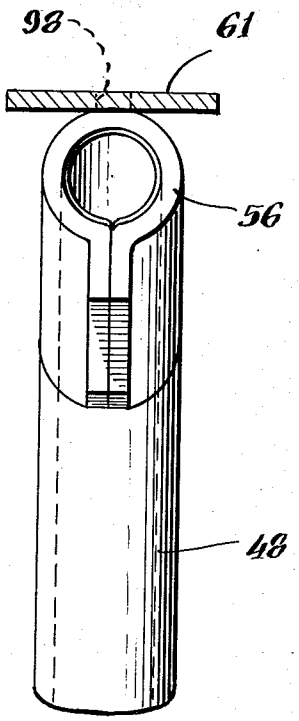
FIG. 6 is a sectional and elevational view taken along the plane 6—6 in FIG. 7 showing the end of one of the wrap-around coolant nozzles with a fingernail extender for controlling and positioning the application of coolant.

Near the entrance to the casting region, as shown in FIGS. 3, 4 and 5, the ends of the tubes 48 and 52 are formed into nozzles 56 positioned close to the reverse face R of each belt. These nozzles are aimed at small angles approaching tangency toward the reverse belt face R. The cross-sectional area of the nozzle bore is substantially less than the oval passages within the tubes 48 and 52, so that each stream 57 of coolant issues from its nozzle 56 at high velocity. The fingernail-like extensions 61, which are attached to the nozzles 56, are novel and their purposes and functions will be described further below. These fingernail extensions 61 are shown more clearly in FIGS. 6 and 7.

As shown in FIG. 3, the molten metal 55 from the tundish 15, passes through an insulated spout 58 which is aimed directly into the entrance E to the casting region. The end of this spout is shown projecting into the casting entrance slightly beyond a line 60 joining the axes of the rolls 28 and 32. In other words, the end of this spout 58 is positioned just beyond the point of tangency of the belts 14 and 16 and their respective nip rolls 28 and 32. The entry E of the casting region begins at the exit face of the nozzle 58. The molten metal 55 initially comes into contact with the front faces of the casting belts at the entry E.

For further information about twin-belt casting machines, the reader may refer to the United States patents listed in the introductory portion of the specification.

DETAILED DESCRIPTION AND ANALYSIS OF PRIOR ART

Figures 8, 8A, 8B:
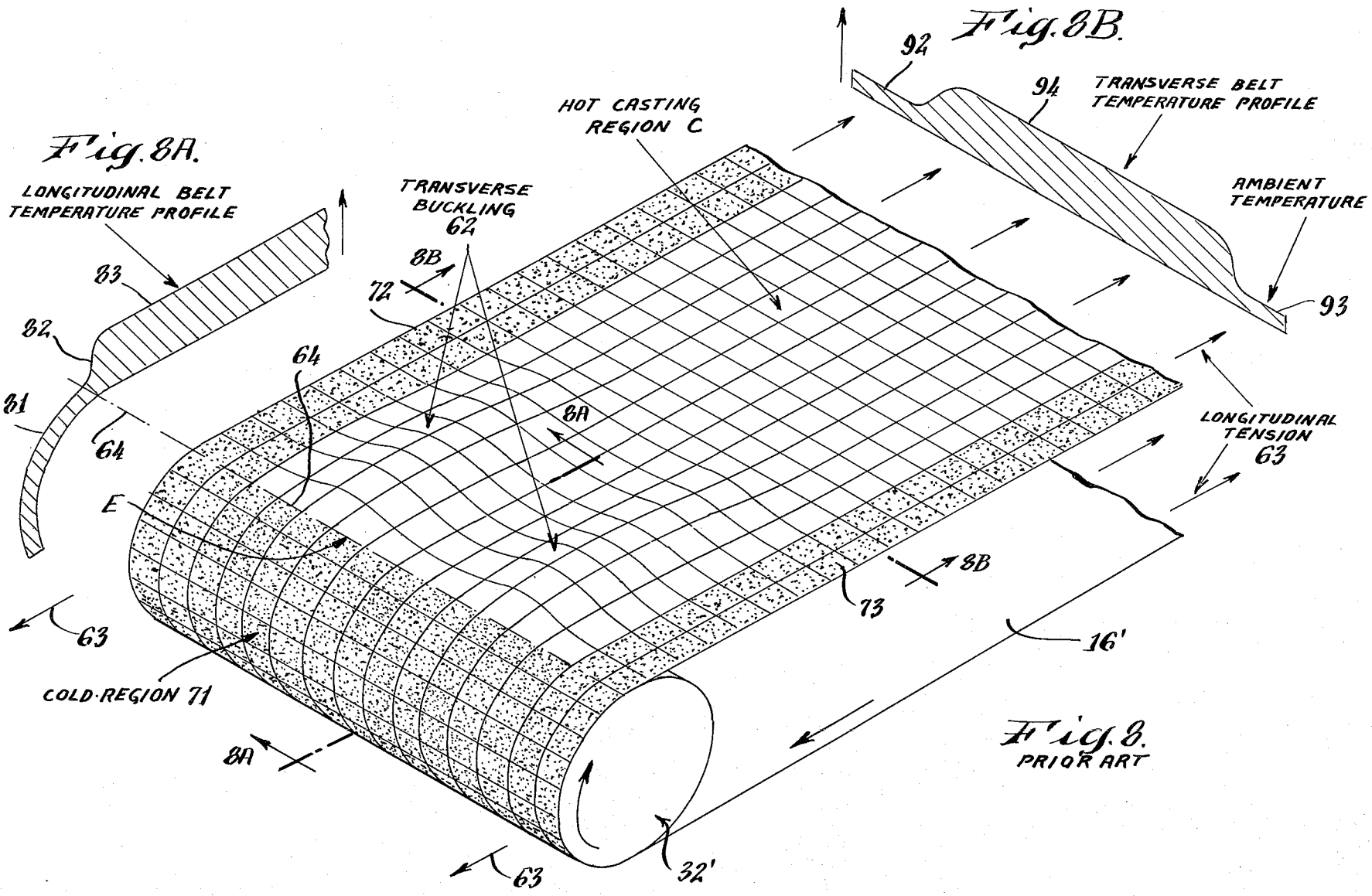
Fig. 8. PRIOR ART
FIG. 8 is a perspective view of a flexible casting belt in the prior art.
FIG. 8A is a diagrammatic plot of the belt temperature profile along the longitudinal section 8A—8A in FIG. 8.
FIG. 8B is a diagrammatic plot of the belt temperature profile along the transverse section 8B—8B in FIG. 8.

In a prior art twin-belt casting machine, belt distortion could occur under certain operating conditions near the hot entrance to the casting region, as illustrated in FIG. 8. This distortion or transverse buckling, as indicated at 62, could occur momentarily or more or less continuously, depending upon operating conditions, and was caused by restraint of the transverse thermal expandion of the casting belt near the hot entrance by cold framing on three sides 71, 72 and 73 of this buckling region. The transverse buckling 62 (FIG. 8) was principally caused by the transverse cold framing occurring in the region 71 ahead of the initial line 64 of contact of the molten metal with the casting belt.

The prior art practice of applying insulative coating on the front belt face and of maintaining substantial longitudinal tension 63 across the full width of the belt did minimize distortion over a majority of the casting region. Nevertheless, these prior art practices often did not eliminate transverse buckling at 62 in a region just downstream from the entrance E, as will be explained.

In the prior art as shown in FIG. 8, the lower casting belt is indicated by 16' and the lower nip roll by 32'. The entrance region E extends transversely across the belt approximately along the position of the line 64 of initial metal contact. The cold regions of the belt are shown by dotted shading. The full width of the belt as it wraps around the nip roll 32' was cold. It was chilled by the nip roll itself, which approached ambient temperature. Also, the belt was chilled by the coolant streams 57 which struck the reverse surface R many inches ahead of the line of tangency 60 (FIG. 3), for the fingernails 61 were absent in the prior art.

Figure 11:
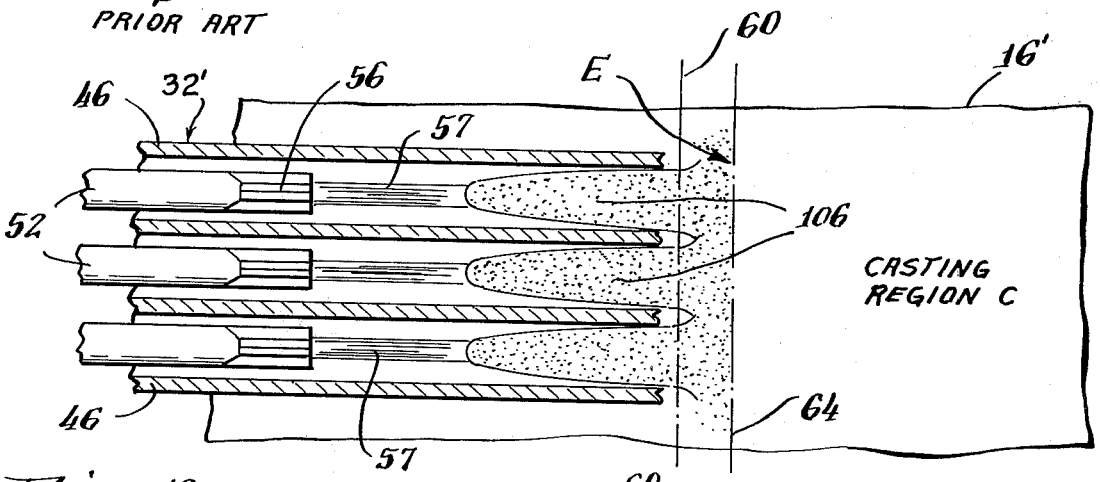
Fig. 11. PRIOR ART
FIG. 11 is a partial sectional view illustrating the action of the curved coolant tubes nested between the ridges of the nip roll of a prior art twin-belt casting machine.

As shown in FIG. 11, in the prior art, twin-belt casting machines, the streams of coolant 57 from the nozzles 56 were applied directly to the reverse surface R of the casting belt 16'. To assure that the coolant was adequately spread out on the belt and was closely hugging against the belt, the nozzles 56, in the prior art, were positioned a substantial distance ahead of the line 64 at the entrance E to the casting region C where the molten metal first came into contact with the casting belt. The shaded areas 106 in FIG. 13 show the pattern of the coolant spreading out against the reverse belt surfaces, and this occurs a substantial distance and a substantial time before the contact line 64 of molten metal occurs. The coolant spread out in the channels between the respective narrow ridges 46 of the roll 32'. As a result of the substantial length of travel of the coolant pattern 106 along the casting belt, the region of the belt 71 (FIG. 8B) ahead of the casting region was markedly chilled by the coolant. Thus, the full width of the belt as it approached the entrance E formed a first cold frame 71 (FIG. 8).

The initial cold condition of the belt is shown in FIG. 8A by the low level of the longitudinal temperature profile curve 81. After the belt passed the entrance line 64 at E, the molten metal 55 came in contact with its front face F. The temperature of the belt rapidly rose up after contact with the molten metal, as indicated by the upwardly sloping profile 82. Soon the mean temperature of the main central portion of the belt reached the elevated level, as indicated by the elevated profile at 83.

The shaded edge portions 72 and 73 indicate two more cold frames. These edge portions 72 and 73 project outwardly beyond the side dams, and they remained substantially at ambient temperature along both edges of the casting region.

The temperature profile extending transversely across the belt along the section 8B—8B is shown in FIG. 8B. The low level portions 92 and 93 of this profile indicate the ambient temperature of the two edge portions 72 and 73. The elevated central portion 94 shows the elevated mean temperature of the hot main central portion of the belt in the casting region.

Accordingly, the main central portion of the belt after passing the line 64 of initial metal contact rapidly rose (as at 82) in temperature and correspondingly attemped to expand. The cold frame portions 71, 72 and 73 restrained this expansion. The framing 72 and 73 restrained the longitudinal expansion somewhat, but this edge framing was mostly overcome by the high longitudinal tension 63 used in the prior art. The lead-in, or pre-entrance, transverse, cold framing 71 imposed a severe restraint on the expanding belt, causing prior art distortion or transverse buckling 62 to occur just downstream from the initial metal contact line 64 at the entrance E. The amount of buckling 62 depended upon the operating conditions, but generally it increased with the melting temperature of the metal 55 being cast.

Also, the sudden rise in temperature 82 (FIG. 8A) subjected the belt and its coating to thermal shock and differential expansion stresses.

ELEVATION OF CASTING BELT TEMPERATURE BEFORE INITIAL CONTACT WITH MOLTEN METAL

In order to overcome this problem of distortion or transverse buckling closely downstream from the entrance E due to transverse restraint of this region's thermal expansion, in accordance with the invention, the temperature of each casting belt is elevated ahead of the line 64 and the application of the coolant streams 57 to the reverse surface may be sharply defined and precisely controlled so as to be applied to the belt at a line closely related to the line 64 of iniitial metal contact with the belt. This control of the coolant will be explained in greater detail further below.

In order to elevate the temperature of the casting belts, as shown in FIGS. 1 and 2, a first bank 66 of multiple radiant heaters 68 held by supports 67 is mounted to heat the upper stretch of the upper belt during its return trip toward the top of the nip roll 28. This first heater bank is mounted on the upper carriage structure U and is positioned to commence heating the upper belt 14 an appreciable distance ahead of the nip roll 28 for significant pre-heating (and transverse expansion) to occur before the belt 14 encounters nip roll 28. In this embodiment, the intensive radiant pre-heating of the upper belt begins at a point approximately equidistant between the downstream pulley 30 and the nip pulley 28.

Heaters 68 may be electrically energized or they may be fossil fuel fired, for example gas fired, of the so-called flameless radiant type. It is preferable to use electrical energy if it can be obtained economically because there is no chance thereby of contaminating the coating on the front face of the belt. Flameless gas fired radiant heaters can be used satisfactorily if the fuel flow rate is carefully adjusted so that there are no tongues of flame issuing from the burner housing 68.

The radiant heaters 68 are capable of providing intensive radiant energy and are positioned closely adjacent and parallel to and uniformly spaced from the front belt surface, and they include polished reflectors 69 extending across the width of the belt for reflectively directing as much of the available radiant energy toward the belt as possible. It has been found to be of advantage to mount all heaters at a small spacing from the front face F of the belt. For example, a small spacing of approximately one inch from the front belt face F has been found to work to advantage with the reflectors 69 aimed at an angle of incidence perpendicular to the belt face F.

A second bank 76 of similar heaters 68 is similarly mounted by means of an arcuate support 77 along a curved path nested about the nip pulley 68. This second radiant heater bank 76 further heats the belt 14 as it is travelling down around the nip roll 28.

Similarly, for heating the lower stretch of the lower belt during its return trip toward the bottom of the nip roll 32, there is a third bank 86 of similar radiant heaters 68 mounted by a support 87. This lower bank 86 is positioned to begin heating the lower belt 16 an appreciable distance ahead of the nip roll 32 for significant pre-heating (and transverse expansion) to occur before the belt 16 encounters the nip roll 32. In this embodiment, this intensive radiant pre-heating of the lower belt begins at a point approximately equidistant between the downstream roll 34 and the nip roll 32. A fourth bank 96 of similar heaters is mounted by means of an arcuate support 97 in curved relationship nested about the nip roll 32. This fourth bank 96 further heats the lower belt 16 as it is travelling up around the nip roll 32.

These heaters are connected so that the four banks 66, 76, 86 and 96 can be independently controlled. The first and third banks 66 and 86 are used to pre-heat the stretches of each belt before the belt begins to wrap around the nip roll 28 or 32. The second and fourth banks 76 and 96 serve to further heat each belt while it is in contact with its nip roll.

If more than sufficient pre-heating is being obtained for casting a particular product, then the number of heaters 68 for each belt may be reduced. Also, one of the banks 66 or 67, 86 or 96 for each belt may be energized without energizing the other bank. However, for most cases, it is believed that it is preferable to utilize a relatively large number of heaters spaced over a relatively large segment of belt travel, as shown, so that the elevation in belt temperature is accomplished relatively gradually to minimize thermal gradients and to minimize differential expansion. In addition, by virtue of the fact that the radiant heat is being applied to the front face F of each belt, it can be used to cure or dry any coating material applied to the belt.

ZONE CONTROL OF BELT PRE-HEATING

In the machine shown in FIGS. 1 and 2, the heaters 68 are all controllable with respect to three zones. The first zone 1 (FIG. 2) spans transversely across the main central portion of each belt for a width equal to the width of the casting region C. The second and third zones (2) and (3) span transversely across the respective edge portions of each belt outside of the casting region. The second and third zones of each heater are ganged together so that the two edge portions of each belt can be correspondingly and equally pre-heated independently of the amount of pre-heating being applied across the main central portion 1 of each belt.

CONTROLLING THE COOLANT STREAMS FROM THE CURVED NIP ROLL TUBES TO AID BELT PRE-HEATING

In order to enhance the effect of the pre-heating of each belt, the fingernail shields 61 (FIGS. 6 and 7) may be employed. These shields 61 are attached by welding or brazing at 98 and 99 to the nozzle 56 of each of the curved coolant tubes 48 and 52. These fingernail extensions 61 are generally rectangular in shape and they are sharply tapered to a precise edge 100 extending sufficiently far downstream from the nozzles to form the coolant streams into layers before applying the coolant to the belt. In this machine, the fingernail extensions project more than two inches beyond the end of the nozzle 56. These fingernail shields 61 have a width just slightly less than the width of the groove 44, as shown in FIGS. 4 and 5. They provide controlled and delayed application of the coolant to the reverse face R until the desired point, for example just immediately before the belt tangent line 60 (FIG. 3). In this illustrative embodiment, the coolant streams 57 do not contact the pre-heated belt until approximately one-half inch or less before the molten metal contacts the belt.

Figure 12:
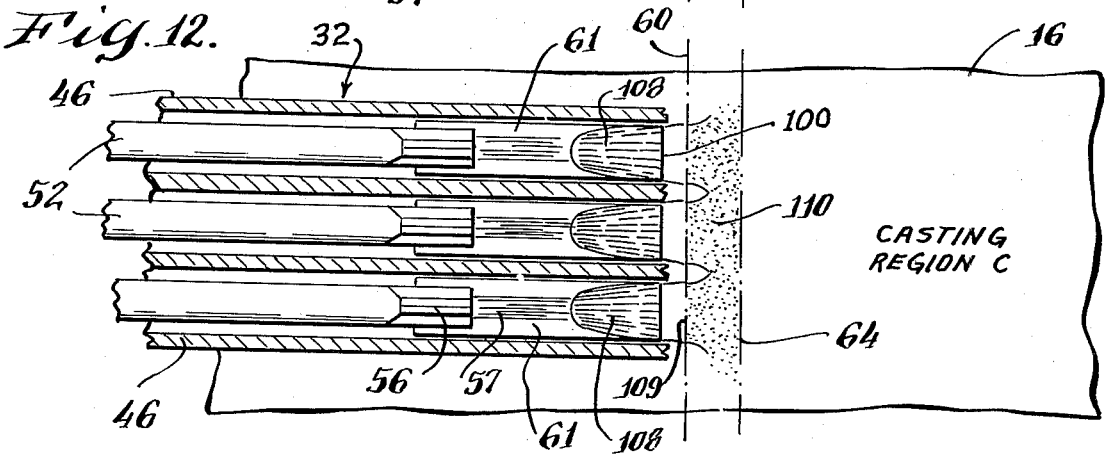
FIG. 12 is a partial sectional view taken along the curved line 12—12 in FIG. 3.

The action of these nozzle tube extensions 61 may be more fully understood from a review of FIG. 12. The coolant streams 57 strike the extenders and spread out laterally across them, as shown by the curved patterns 108. A uniform layer of coolant is thereby formed before the travelling liquid reaches the edge 100 of these extenders. The fast moving layer of coolant leaves the edge 100 and travels a short distance before coming in contact with the reverse surface of the belt. The pattern which this coolant forms in engaging the belt is shown by the shaded area 110 in FIG. 12. It is noted that the line 109 where the coolant initially contacts the belt is accurately defined as compared with the curves 106 (FIG. 11). Accordingly, the well defined line 109 enables the coolant application to be accurately controlled and to be positioned close to the line of tangency 60, where the belt is separating from the ridges 46 on the roll and also to be positioned close to the line 64 where the molten metal contacts the front face of the belt.

Figure 7:
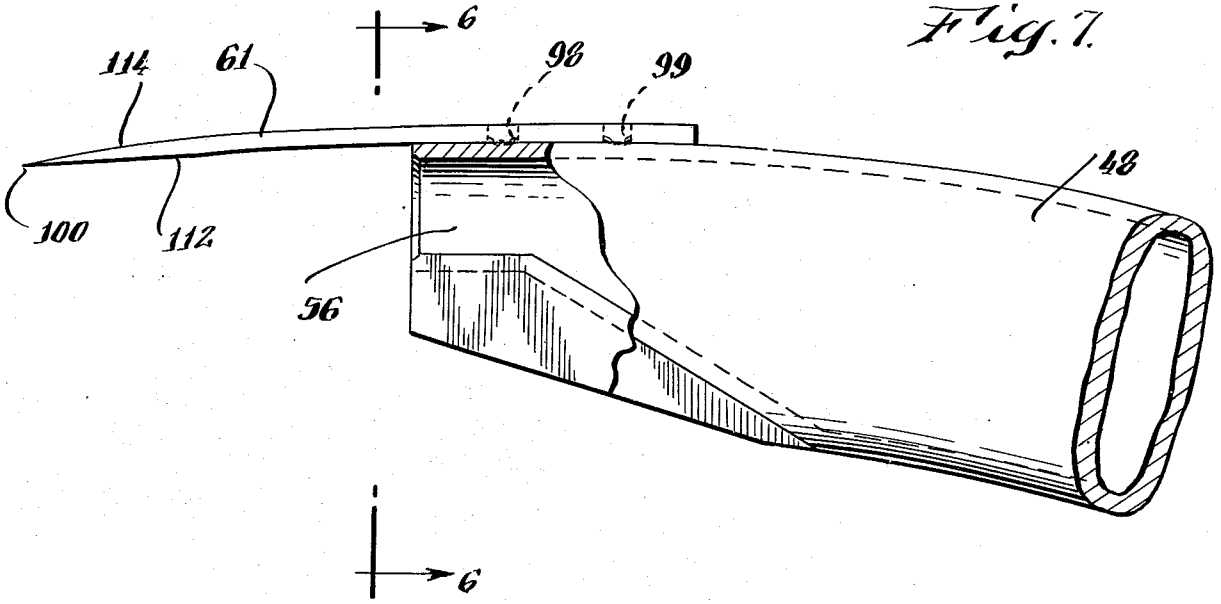
FIG. 7 is a side elevational view of this nozzle and fingernail extender.

As seen enlarged in FIG. 7, the inner surface 112 of the extenders 61 is smooth and is tapered by grinding to form a sharp edge 100. The outer surface 114 of the extenders is curved in a gentle arc commensurate with the arc of the belt so that the tip 100 can be positioned closely adjacent to the surface of the casting belt, as shown in FIG. 3.

It is important that effective cooling action be present on the rear surface of the belt at or near the position 64 (FIGS. 8 and 12) where the molten metal initially comes into contact with the front face of the belt.

When the extensions 61 are used, the nozzles 56 at the ends of the curved tubes 48 and 52 are enabled to be positioned significantly farther downstream near the molten metal line 64 as compared with the bare nozzles 56 of the prior art, because of the increased control over the coolant stream patterns.

Consequently, the fingernail extenders 61 serve the functions of spreading out the coolant to form a layer while at the same time preventing the coolant from prematurely engaging the belt. By virtue of the fact that the coolant is formed into a stabilized layer, its appllication to the belt 16 can be delayed until line 109 which is located only a small distance before the line 64 at whichthe molten metal contacts the belt.

A NUMBER OF BENEFICIAL EFFECTS OF PRE-HEATING THE CASTING BELTS

Figure 9:
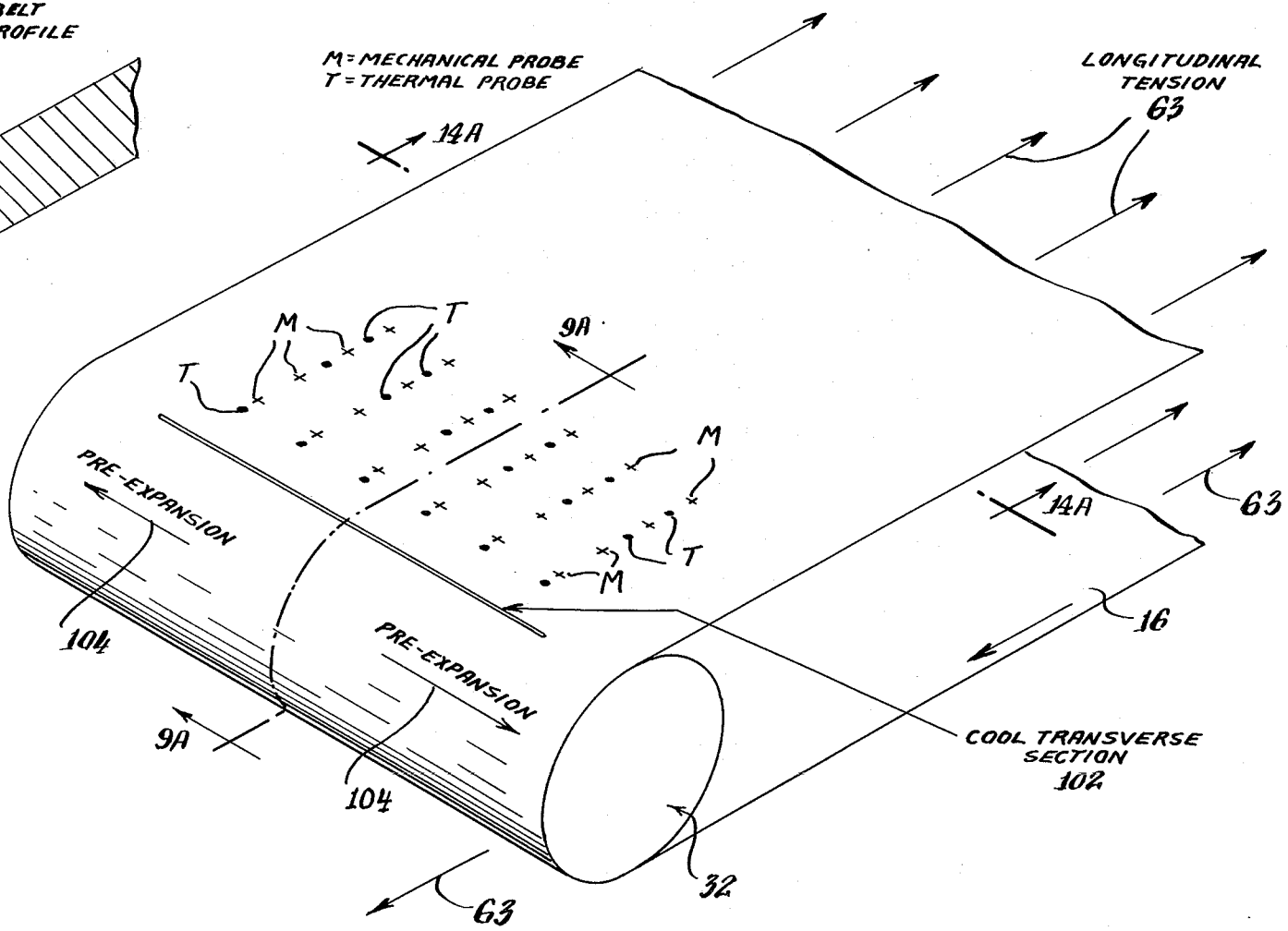
FIG. 9 is a perspective view of a flexible casting belt being utilized with the present invention.
Figure 9A:
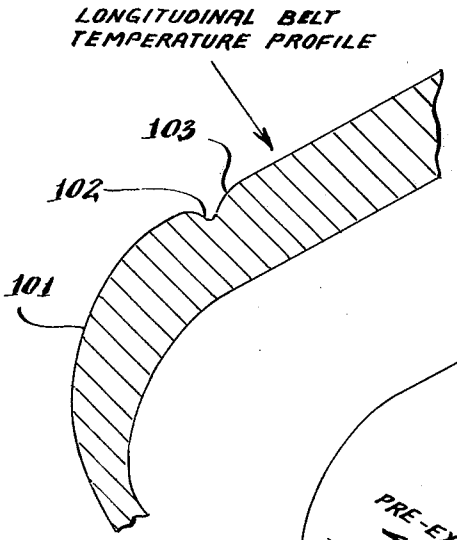
FIG. 9A is a diagrammatic plot of the belt temperature profile along the longitudinal section 9A—9A in FIG. 9.

The advantageous results of pre-heating the belts plus controlled and delayed application of liquid coolant to the belts is shown in FIGS. 9 and 9A. The longitudinal belt temperature profile has a steady rise along the curve 101, so that substantially full operating temperature and full pre-expansion occurs in the pre-entrance region. As shown by the arrows 104, the full transverse pre-expansion has occurred before the casting belt reaches the tangency line at the entrance.

A very narrow cool transverse section 102 may be produced over the narrow band 110 (FIG. 12) where the coolant contacts the belt before the molten metal contacts the belt. However, this cool transverse section 102 is so narrow that it does not have any significant restraining effect on the belt. The pre-heated, pre-expanded belt being stabilized by lying curved around the nip roll 32 completely dominates the narrow cool band 102. Very quickly the belt temperature rises back up at 103 to its full operating temperature. The beneficial effect is to eliminate or minimize to an insignificant level the tendency of the belt to distory or buckle. Thermal shock to the belt and its coating are minimized and stresses due to differential thermal expansion are minimized. Other beneficial effects and advantages are discussed elsewhere.

PRE-HEATING OF CASTING BELTS IN TWIN-BELT MACHINES HAVING MORE THAN TWO MAIN ROLLS IN EACH CARRIAGE

Figure 10:
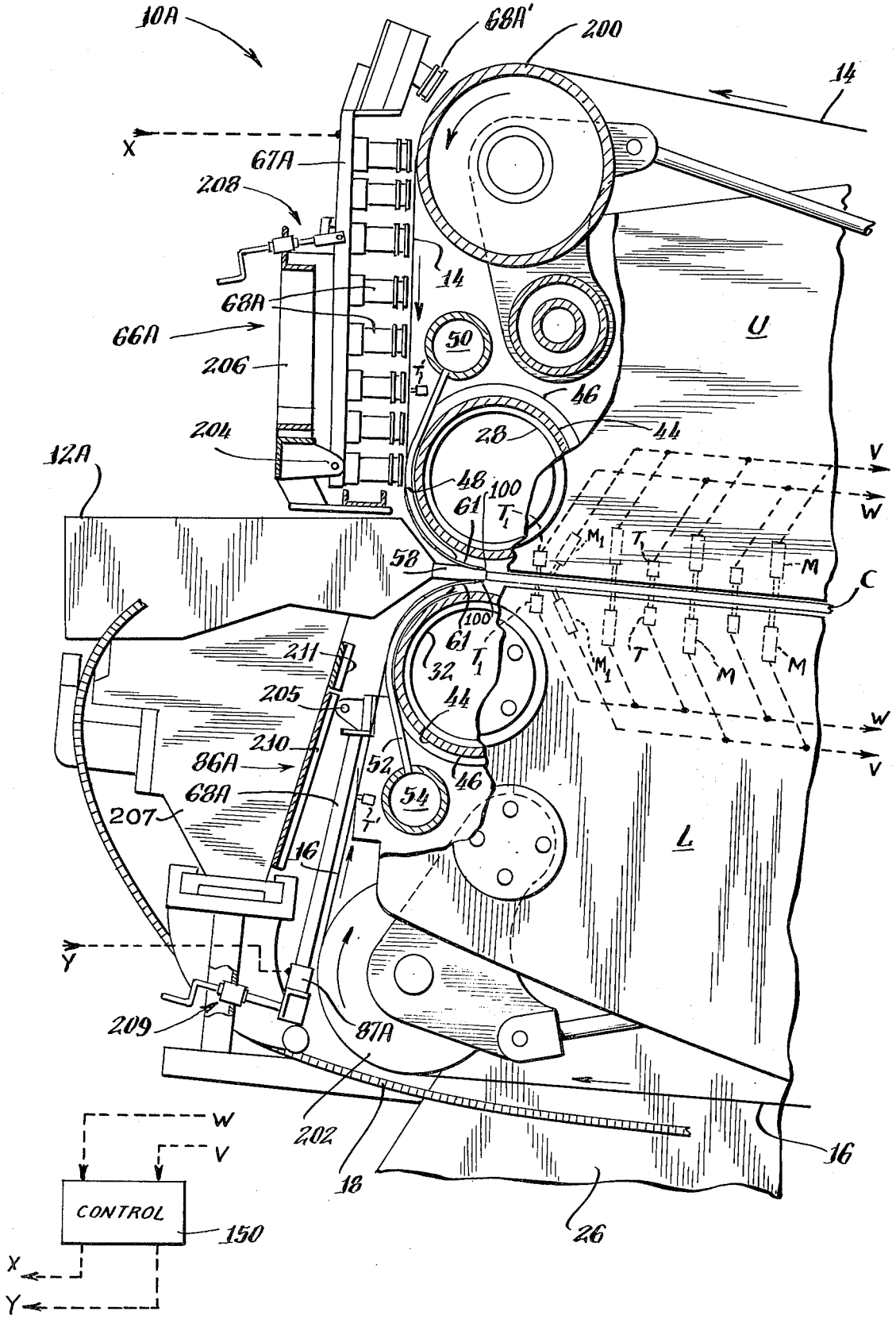
FIG. 10 is a sectional view of another type of twin-belt casting machine embodying the present invention.

The twin-belt casting machine 10A shown in FIG. 10 includes more than two main rolls in each belt carriage U and L. For clarity of illustration, only the input or upstream end of the machine is shown. There are nip rolls 23 and 32 having deep grooves 44 with narrow ridges 46. Belt-tensioning rolls 200 and 202 serve to apply tension to the casting belts 14 and 16. Other main rolls (not shown) are located at the downstream end of the machine.

The molten metal feeds from a tundish 12A through a spout 58 leading into the machine in an injection feeding arrangement. For further information about twin-belt casting machines with injection feeding and having more than two main rolls in each carriage, the reader may refer particularly to U.S. Pat. Nos. 3,167,830 and 3,310,849 among those listed in the introduction. The first of these patents shows a "three-roll" machine and the second shows a "four-roll" machine.

A bank 66A of infra-red heaters 68A mounted on a support frame 67A serves to heat the stretch of belt 14 between the main rolls 200 and 28. Additional heaters, such as shown at 68A', may begin heating the belt while it is still travelling around the roll 200 preceding the nip roll 28. These heaters 68A and 68A' are shown as being fossil fuel fired, in this example they are gas fired, and they are mounted to be spaced only a small distance from the front face of the belt 14. These heaters are of the flameless gas burning type producing intensive infra-red radiation. If desired, electrically energized heaters 68A may be used in lieu of fuel-fired ones.

The heater support 67A is pivoted at 204 to a mounting frame 206 which is connected to the upper carriage U. A position adjustment mechanism 208 extends between the fixed mounting 206 and the pivoted heater support 67A. Thus, the position of the heaters 68A and 68A' can be set in accordance with the position of belt 14 as determined by the adjustable belt-tension roll 200.

Another bank 86A of similar heaters 68A mounted on a support frame 87A serves to heat the stretch of the belt 16 between rolls 202 and 32. The support 87A is pivoted at 205 to a mounting 207 for the tundish 12A. An adjustment mechanism 209 extending between the fixed mounting 207 and the pivoted heater support 87A serves to adjust the position of the heaters 68A, in accordance with the location of the belt as determined by tensioning roll 202. The heaters 68A on the frame 87A extend generally vertically and are transversely inclined to provide uniform overlapping pre-heating effect on the belt 16. This mounting arrangement of the lower heaters is accommodating to the limited available space between the tundish mounting 207 and the lower carriage L. Insulating pads 210 and 211 are shown attached to the tundish mounting 207 to avoid over-heating of this mounting by the bank 86A of intensive infra-red heaters directed at the front face of the belt 16.

The curved coolant tubes 48 and 52 extending from header conduits 50 and 54 and nested within the roll grooves 44 may be equipped with fingernail extenders 61 similar to those described above.

Whereas the belts 14 and 16 in the machine 10 travel approximately 180° around the nip rolls 28 and 32, the belts in the machine 10A (FIG. 10) travel approximately 90° around their nip rolls. In spite of this difference between the machines and the differences in arrangement and mounting of the heaters 68 and 68A, the advantages and effects of the belt pre-heating in the machine 10A are similar to those described above for the machine 10.

ADDITIONAL METHODS AND APPARATUS FOR PRE-HEATING THE CASTING BELTS

As shown in FIG. 2, the casting belts can be preheated by heating the nip rolls 28 and 32 in either the machine 10 or 10A. This pre-heating of the nip rolls can be carried out in conjunction with the use of the radiant heaters 68 or 68A, if desired. Alternatively, the heating of the nip rolls can be carried out without the use of the radiant heaters. It is preferred that the radiant heaters be utilized because they serve to heat the front face of the belt which is the same surface as comes in contact with the molten metal.

As shown in FIG. 2, hot heating fluid, such as steam, may be supplied through an insulated pipe 160 connected to a stationary gland member 162 for heating the nip roll.

Another method for pre-heating the casting belts is to inject hot fluid, for example such as dry steam, which may be superheated, if desired, directly into the nip roll grooves 44 beneath the reverse surfaces R of the casting belts. The manner in which this hot fluid is injected into the grooves 44 is to position conduits (not shown) near the header pipes 50 and 54 in the machine 10 or 10A. Nozzles for the hot fluid (not shown) are connected to such conduits similar to the way in which the coolant tubes 48 and 54 are connected to the headers 50 and 54. These hot fluid nozzles are aimed into the spaces around the coolant tubes within the respective grooves 44, and the coolant tubes 48 and 52 are insulated from this hot fluid.

INSULATING THE NIP ROLLS

While the fingernail extenders 61 mask off the collant from the belt, it is to be noted from FIG. 12 that the coolant layers 108 may strike the side surfaces of the ridges 46 on the nip rolls, producing a cooling action on the roll itself. Since the nip rolls have substantial arcs of contact with the belts, this cooling effect is conducted into the belts.

In order to insulate the grooves 44 from the coolant, a thermal insulation coating 190 (FIGS. 4 and 5) can be applied, as by painting or spraying, to cover the side walls and bottom of each groove 44.

Alternatively, the rim portions of the ridges 46 can be fabricated as rings (not shown) separate from the main body of the nip roll. These rings are then mounted onto the nip rolls with a layer of insulation material thermally isolating the rim portion of each ridge 46 from the remainder of the nip roll.

BELT PRE-HEATING CONTROl METHODS AND APPARATUS

In order to provide precise control over the pre-heating of the belt, and in order to sense whether any transverse buckling 62 (FIG. 8) is occurring, mechanical sensors M and thermal sensors T (FIGS. 1, 9 and 10) may be installed.

Any buckling of the belt causes the sensor M to generate an electrical signal as a function of the movement, and this electrical signal is fed through an electrical cable connection V.

The thermal probes T provide an electrical signal as a function of the temperature of the reverse surface of the belt. This electrical signal is fed from the respective thermal probes through electrical cables W.

A first thermal probe T, is positioned closely adjacent to the nip rolls, as seen in FIGS. 1 and 10. The first mechanical probe M engages the reverse surface of the casting belt relatively close to the line 64 FIG. 12 at which the molten metal first contacts the casting belt.

Asi illustrated in FIGS. 1, 9 and 10, there are three thermal probes T, indicated by dots in FIG. 9, and four mechanical probes M, arranged in a row. There are a plurality of these rows of probes positioned across the width of the casting belt. For example, FIG. 9 shows six rows of these mechanical and thermal probes M and T.

The thermal sensors T may be construed similar to the sensors as described in detail and claimed in a copending application of Charles J. Petry, Ser. No. 343,884, filed Mar. 22, 1973, now issued an U.S. Pat. No. 3,864,973.

As diagrammatically illustrated in FIGS. 1 and 10, in order to provide automatic control of the pre-heating of the casting belts, the various electrical cables V and W from the mechanical probes M and thermal probes T are connected to a control circuit 150. These control circuits serve to control the energization of the banks of infra-red heaters 66, 76, 86 and 96 and 66A and 86A. In addition, these control circuits 150 may also control the relative energization of the center zone 1 and the two end zones 2 and 3 (FIG. 2) of these heaters.

It is to be understood that the heaters 68A of the machine 10A in FIG. 10 can be arranged for zone control similar to that described for the heaters 68 in the machine 10. The solidification rate in the casting zone C depends on many factors, including the composition of the molten metal 55, speed of the machine, thickness of the casting being made, and so forth.

VARIOUS CONTROLLED BELT PRE-HEATING METHODS AND ARRANGEMENTS

Various controlled belt pre-heating methods and arrangements can be employed as will be explained in connection with FIGS. 13A, B and C and FIGS. 14A, B and C.

Figure 13A:
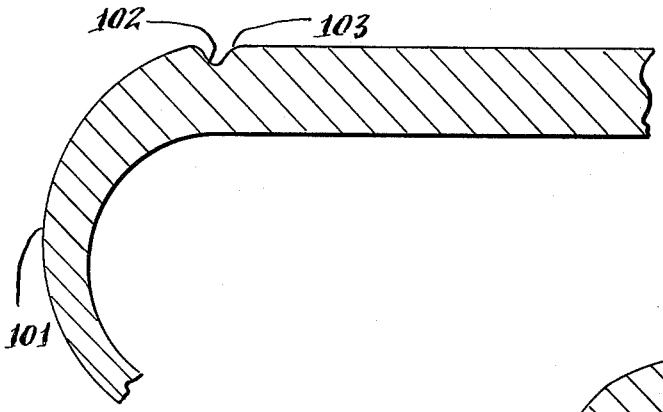
FIG. 13A is a diagrammatic plot of the longitudinal temperature profile of the casting belt in a machine embodying the invention.

FIG. 13A corresponds with FIG. 9A and shows the method of pre-heating the casting belt in which there is a narrow region 102 of slight cooling produced by the narrow area of coolant 110 (FIG. 12) which contacts the casting belt slightly before the molten metal.

Figure 13B:
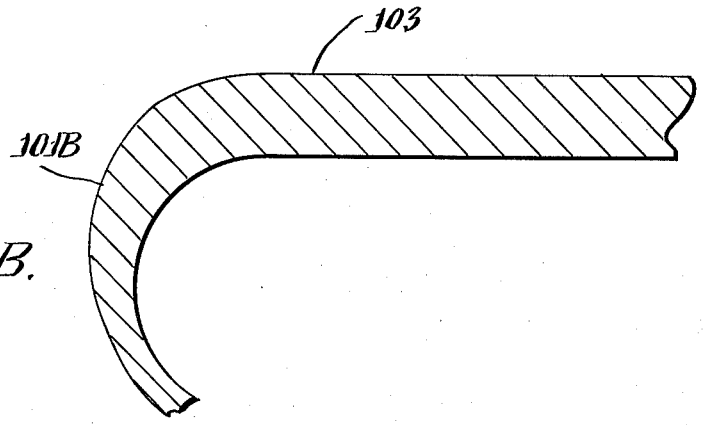
FIGS. 13B and 13C show other diagrammatic plots of longitudinal temperature profiles of casting belts, being taken along planes corresponding in position to 9A—9A in FIG. 9 in machines embodying the invention.

If desired, the relative positions of the nozzles 56 and fingernail extenders 61 and the end of the spout 58, FIGS. 3 and 10, where the molten metal first contacts the belt, can be arranged so that the position 109 (FIG. 12) where the controlled coolant first contacts the reverse side of the belt almost coincides with the line 64 where the molten metal first contacts the front face of the belt. When this adjustment is achieved, the result is to provide a pre-heating pattern as shown in FIG. 13B, in which the pre-heating temperature curve 101B directly meets with the temperature curve 103 downstream from the entrance to the casting region. In other words, FIG. 13B shows an actual continuity of the pre-heating temperature profile with respect to the temperature profile in the casting region.

Figure 13C:
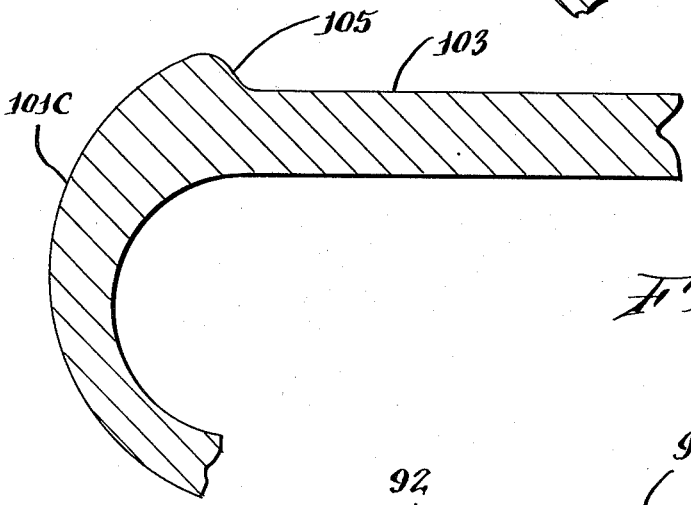

If desired, the pre-heating of the casting belt can be carried out to a higher temperature 101C, as shown in FIG. 13C, in other words, a temperature overshoot 105 is provided. The result of this temperature overshoot is that the pre-expansion 104 (FIG. 9) is greater and thereby tends to stretch the casting belt transversely to assure that the belt is held flat at the entrance to the casting region.

Figure 14A:
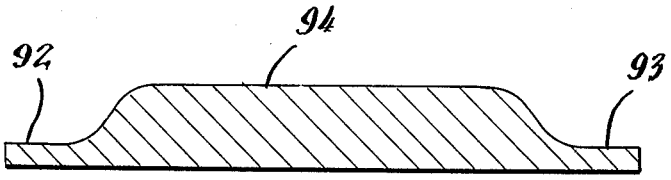
FIG. 14A is a diagrammatic plot of the transverse temperature profile taken along the plane 14A—14A in FIG. 9 through the casting belt of a machine embodying the invention.
Figure 14B:
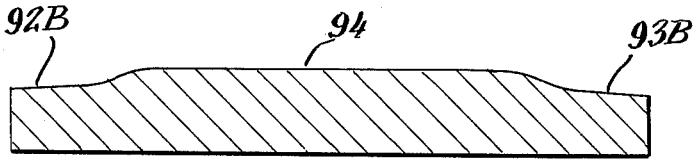
FIGS. 14B and 14C show other diagrammatic plots of transverse temperature profiles taken along planes corresponding in position to 14A—14A in FIG. 9 in machines embodying the invention in which the edge portions of the belt are elevated in temperature.

FIG. 14A shows a transverse temperature profile curve 92, 93, 94 taken along the plane 14A—14A in FIG. 9. The edge portions of the belt as shwon at 92 and 93 are much cooler than the mean temperature 94 of the main central area of the belt near the casting region. If desired, as shown in FIG. 14B, the edge portions of the belt in the zones 2 and 3 (FIG. 2) and corresponding zones in FIG. 10 can be pre-heated to provide a transverse belt temperature profile, as shown in FIG. 14B, in which the temperature profile 92B and 93B of the belt edge portions is more nearly equal to the temperature profile 94 of the center portion of the belt. There is some loss of heat from the edge portions of the belt such that when the edge portions are preheated to the same temperature as the center portions, some cooling of the edges will occur as the belt moves along through the casting region. This edge cooling explains the profile shown in FIG. 14B in which the level of temperature in the edge portions 92B and 93B is somewhat lower than the central temperature profile 94.

Figure 14C:
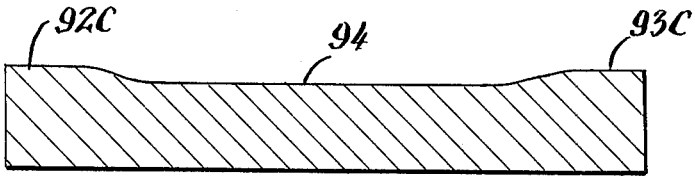

If desired, as shown in FIG. 14C, a temperature overshoot can be provided in the heating of the edge portions as shown by the temperature profile 92C and 93C. This temperature overshoot compensates for the subsequent cooling of the belt edge portions as the belts travel along the casting region.

As a further step for heating up and maintaining the temperature of the edge portions of the belts 14 and 16, the coolant application nozzles (not shown, which are generally similar to those shown in U.S. Pat. No. 3,041,686, mentioned in the introduction) leading from the coolant conduits as shown in that patent may be selectively temporarily blocked off by plug means, such as screw plugs inserted into the bores of these nozzles. The nozzles are selectively blocked off with respect to the edge portions of the casting belt lying outside of the casting region, i.e. in the regions corresponding with zones 2 and 3 in FIG. 2. Thus, the cooling applied to edge portions of the belts associated with the temperature profiles 92, 93 or 92B, 93B or 92C, 93C in FIGS. 14A, B or C is minimized. In the region (zone 1) corresponding with the main central portion of each belt passing adjacent to the casting region, the nozzles remain open to apply and propel the coolant along the reverse surface of the casting belt.

If the distance between the side dams 18 is increased for enlarging the width of the casting region C to cast wider product, then corresponding ones of the nozzles are unplugged to apply the coolant across the full width of the wider casting region, and vice versa. Also, if such a change in casting width is made, the zone control for the heaters 68 or 68A may be correspondingly adjusted.

THE METHODS OF THE INVENTION CAN BE APPLIED TO TWIN-BELT MACHINES OF ALL TYPES

Although FIGS. 1, 3 and 10 illustrate twin-belt casting machines in which the molten metal is supplied to the casting region by injection feeding, it is to be understood by those skilled in the art that the methods of the invention can be applied to twin-belt casting machines regardless of whether the feeding of the molten metal is by open pool, closed pool or injection feeding. In the cases of an open pool or closed pool feeding, the nip roll of the lower casting belt may be located farther upstream than the nip roll for the upper belt. These relative possible positions of the nip rolls are shown in U.S. Pat. Nos. 2,904,860; 3,036,348; 3,123,874; 3,142,873; 3,228,072; and FIGS. 14A, 14B, 14C, 14D and 14E of U.S. Pat. No. 3,167,830. The methods of the invention are arranged accordingly.

MEAN BELT TEMPERATURES ARE ILLUSTRATED AND DESCRIBED

The various belt temperature profile curves and associated description illustrate and describe the mean temperatures of the belt as taken in a section through the thickness of the belt at any given location. It is to be understood that there is a temperature gradient through the thickness of the belts as seen in FIG. 3. The front faces F of the two belts adjacent to the molten metal 55 or the solidifying metal in the casting region C are quite hot. The rear faces R adjacent to the liquid coolant are much cooler. Thus, it is to be understood that the specification, drawings and claims are speaking about mean belt temperatures.

For example, in FIG. 13C, the temperature overshoot 105 indicates that the mean belt temperature along the profile curve 101C is elevated above the mean belt temperature along the profile curve 103.

The temperature sensors T are sensing the temperature of the rear surface R. Because the temperature of the metal being cast is known, the mean belt temperatures can be estimated by using these sensors.

In the case of the regions of the belt approaching the nip rolls, sensors T′ (FIGS. 1 and 10) can be installed to engage the belt before it reaches the nip roll.

ADDITIONAL METHODS FOR INSULATING THE NIP ROLLS

The insulating of the nip rolls is discussed in the specification further above. Additional methods for insulating the nip rolls will now be discussed.

As will be understood from FIGS. 3, 4, 5, 11 and 12, the ridges 46 on the nip rolls 28 and 32 are relatively narrow and the intervening grooves 44 are much wider than these ridges. A method for effectively thermally insulating the nip rolls from the reverse surfaces of the belt is the machining of a narrow secondary groove, such as illustrated in FIGS. 4 and 5 at 216 into the perimeter of each ridge 46. Only one ridge is shown in FIGS. 4 and 5 with such a narrow secondary groove, and it is to be understood that these grooves 216 can be machined into the perimeter of each ridge.

These secondary grooves 216 significantly reduce the area of the perimeter of ridges 46 in contact with the reverse surfaces of the casting belts, and thus these narrow secondary grooves effectively provide thermal insulation directly at the interface between nip roll and belt.

If desired, the perimeter of the ridges 46 containing these narrow secondary grooves can be hardened as by induction heat treating, to increase the wear resistance of these ridges. This hardening of the metal offsets of reduction in area of the perimeter of the ridges with respect to wear resistance.

In addition, a thermally insulative material, for example such as epoxy resin, can be inserted into these narrow secondary grooves 216.

These narrow secondary grooves 216 can be arranged to reduce the effective area of the periphery of the metal ridges 46 to one-half or less of the area thereof previously in contact with the reverse surfaces of the belt. Thus, the conduction heat transfer at this interface between nip roll and belt by this secondary grooving method can be cut down to one-half and less of that which would occur with the configuration of ridges previously used.

A durable thermally insulative material, for example such as epoxy resin or polyurethane, can be held in the narrow secondary grooves 216 and project slightly beyond the perimeter of the ridges 46 under operating conditions to prevent metal-to-metal contact between the belt and ridges 46. Where a thin layer of durable insulative material is applied to the perimeter of each ridge 46, to prevent metal-to-metal contact between the belt and ridges 46, such a layer is keyed into the secondary grooves 216.

FURTHER ASPECTS OF CONTROLLING BELT TEMPERATURE

Another way in which the heating of the nip rolls can be utilized and controlled to advantage is to reduce the flow of heat from the pre-heated belts into the nip rolls. The heaters 68 or 68A (FIGS. 1 or 10) elevate the temperatures of the belts, with the front faces becoming elevated to a higher temperature than the rear surfaces. The heated nip rolls then serve to maintain the elevated temperature of the rear surfaces. In effect the heated nip rolls are serving to stabilize the temperatures of the previously heated belts.

In connection with FIG. 13C overshooting of the elevation of mean belt temperature is discussed. One desirable objective in this overshooting method is to preheat the belts so that the temperatures of the metal surfaces of the belts adjacent to the coatings on their front faces F becomes essentially the same ahead of the casting region as it is in the casting region. Thus, temperature conditions at the interface between the metal of the belt and the coating on the belt are stabilized, and thereby thermal shock at this interface is avoided, whereby belt operating life is extended.

It has already been discussed that the relative positions of the nozzles 56 and the end of the spout 58 can be arranged so that the position where the coolant first contacts the reverse side of the belt almost coincides with the position where the molten metal first contacts the front face of the belt. In some cases these components may be arranged so that the molten metal intentionally does contact the front face of the belt before the coolant contacts the reverse surface; however, there are critical limits to this delayed coolant application. These limits on the amount of delayed coolant application vary with the thickness of the metal in the belt and with the speed of movement of the belt, as shown in the following table which pertains to casting aluminum based metal. In this table "×thickness" means times the thickness of the metal in the belt.

| Belt Speed in Feet per Minute | Maximum Delay Distance for Coolant Application |
|---|---|
| 20 | 6 × thickness |
| 10 | 3 × thickness |

Thus, for example, with a belt metal thickness of 0.050 of an inch at a casting speed of 20 feet per minute the maximum delay distance for cocolant application is 0.3 inch.

One reason why it is an advantage to delay coolant application is that there are transient conditions occurring where the molten metal and coolant are initially contacting opposite sides of the belt. The insulative coating on the belt tends to delay the moment when the heat from the molten metal reaches the belt metal, i.e., it is a relatively slow response heating effect as compared to the action of the coolant which is applied directly to the belt metal to produce a relatively quick response cooling effect. The delaying of the application of the coolant serves to compensate for the delay when the heat reaches the belt metal. Thus, both heating and cooling effects are caused to commence at effectively the same moment on the belt metal in the casting region to enhance operation.

The above table applies to casting aluminum based metals. When casting metals having higher melting temperatures, such as copper or steel then the permissible maximum delay is correspondingly reduced. When casting metals having lower melting temperatures, then the permissible maximum delay is correspondingly increased.

In summary, depending upon the operating conditions, the coolant may be initially applied to the reverse surface of the casting belt within a range from a small distance before, to a small distance after, the position where the molten metal initially comes into contact with the front face of the respective casting belt.

It is discussed that the coolant application nozzles may be selectively blocked off with respect to the edge portions of the casting belt lying outside of the casting region. This is done to minimize cooling of the edge portions of the belts to preserve the pre-heated belt temperatures established ahead of the entrance to the casting region. The objective is to maintain the temperatures of the edge portions of the belt at least as great as the temperatures in the belt across the full width in the casting region.

A further method of preserving the pre-heat in the edge portions of the belts is to apply hot liquid of controlled temperature to these edge portions while cold liquid coolant is being applied to the main central portions of the belts in the casting region. The way in which this is accomplished is to insert an insulated pipe line (not shown) into the coolant conduit. This insulated pipe is connected to insulated localized chambers (not shown) directly feeding the groups of nozzles associated with the two edge portions of the belt. This insulated pipe line and localized chambers are arranged so that they do not obstruct the flow of coolant to the remaining nozzles. The hot liquid used may be hot water.

Since the coolant liquid and hot liquid are travelling longitudinally along the reverse surface of the belt at high velocity in a relatively thin layer, there is very little tendency for these different temperature liquids to mix at their common boundary.

With respect to FIGS. 1 and 10, it is to be understood that the control circuits 150 can be used to control the temperature of the hot fluid fed into the line 160 (FIG. 2) for controlling the temperatures of the respective nip rolls 28 and 32 (FIGS. 1 and 10). Moreover, the control circuits 150 can also be used to control the temperature of the hot liquid to be applied to the edge portions of the belts as described in the preceding paragraph.

EXTENDING BELT OPERATING LIFE

Another aspect of extending belt operating life will be discussed in connection with FIGS. 9, 9A and 12. To provide background information for understanding this aspect, it is noted that in the prior art the casting belts, which are made of sheet steel, with insulative coating on the front face, tend gradually to become stretched longitudinally during operation. This stretching occurs in the main central casting region of the belt relative to its edge portions. Thus, over a period of time the belt may become very slightly baggy or slack in the main central region relative to the edge portions. This stretching is caused by the thermal cycling of the main central region plus the flexing thereof occurring in passing around the main rolls. This slight bagging only occurs when the operating conditions are so severe that the thermal cycling and flexing cycling carry the belt metal into its plastic deformation state as distinguished from the elastic deformation state. Whenever such slight bagging becomes undue in amount for the casting operations being carried out, then the belt is removed and replaced.

As shown in FIGS. 9, 9A and 12, the initial application of the coolant to each belt can be arranged relative to the initial contact of the molten metal such that there is a narrow cool section 102 extending transversely across the belt between the pre-heated expanded region 104 and the casting region. The control of pre-heating and control of initial coolant application can be used to widen or narrow this section 102 as may be desired. The thermal expansion occurring adjacent to this narrow cool section 102 tends to stretch the metal of the belt in this narrow cool section laterally. Moreover, this lateral stretching tendency occurs continuously during operation and progressively for each incremental portion of the main central region of the belt, i.e., it is occurring cyclically and sequentially for each part of the main central region during each revolution of the belt. The result is that this lateral stretching tendency compensates somewhat for the tendency of the belt to become baggy and thereby extends the belt operating life.

It is noted that the tendency of the belt to become baggy increases with higher belt operating temperatures in the casting region due to the combined effects of higher molten metal temperatures and the belt coating practices being employed. Advantageously, the pre-heating 104 is controlled and can be increased correspondingly to the higher belt operating temperatures. Thus the lateral stretching tendency applied to this narrow cool section 102 can be increased in the case of higher belt operating temperatures to match and thereby to compensate for the increased longitudinal strecthing.

This lateral stretching can be considered as corrective transverse stretching carrying the belt metal into teh plastic deformation state transversely to compensate for the belt metal being carried into the plastic deformation state longitudinally. The corrective lateral stretching is correlated to the longitudinal stretching and can be controlled by the pre-heating temperature applied to the belt and by varying the size of the cool section 102. As a result the tendency toward bagginess, if occurring, can be compensated to the extent desired to extend the belt operating life.

We claim:

1. The method of casting molten metal between opposed portions of a pair of revolving endless flexible casting belts wherein the molten metal is brought into contact with the front faces of the respective moving belts and then the molten metal is carried downstream in a casting region defined between the front faces of the belts while the heat from the molten metal in the casting region is withdrawn by applying liquid coolant to the reverse surfaces of the two casting belts, comprising the steps of:

transmitting intensive radiant heat energy onto the front faces of the two belts at close range before the molten metal is brought into contact with the front faces for elevating the temperature of the belts before contact with the molten metal, and initially applying the liquid coolant to the reverse surfaces of the belts only a small distance ahead of the position where the molten metal first comes into contact with the front faces of the belts, whereby distortion of the belts after contact of the molten metal with their front faces is minimized.

2. The method of casting molten metal between opposed portions of a pair of revolving endless flexible casting belts, as claimed in claim 1, in which:

the belts are elevated to mean temperatures before the molten metal is brought into contact with them which are at least as great as the mean temperatures of the belts after the molten metal is brought into contact with them.

3. In a twin-belt casting process wherein the casting region is defined between opposed portions of a pair of revolving endless flexible casting belts and molten metal is introduced into the casting region to be carried along between the travelling belts as it solidifies and wherein the belts travel partially around respective nip rolls positioned upstream from the casting region and said nip rolls have deep circumferential grooves with intervening tall narrow ridges adapted to engage the reverse surfaces of the casting belts travelling around the respective nip rolls, the invention comprising the steps of:

applying heating to said casting belts as they are revolving before the respective belts reach the casting region for pre-heating the belts, and insulating the perimeters of said narrow ridges for reducing the amount of conductive heat transfer occurring between said belts and said nip rolls for reducing the flow of heat from the belts into the nip rolls.

4. The method of casting molten metal in a casting region defined between opposed portions of a pair of revolving endless flexible casting belts each made of relatively thin sheet metal, wherein the molten metal is brought into contact with the front faces of the respective moving belts and then the molten metal is carried downstream in the casting region while heat from the molten metal in the casting region is withdrawn by applying liquid coolant to the reverse surfaces of the two belts, comprising the steps of:

elevating the temperature of at least one of the revolving casting belts, in advance of the casting region for pre-heating the belt, shielding the liquid coolant from the reverse surfaces of said pre-heated casting the belt in advance of the casting region for initially applying the coolant to the reverse surface of the pre-heated belt along a sharply defined line extending transversely across the belt, introducing the molten metal initially into contact with the front face of said belt along a sharply defined line extending transversely across the belt, and arranging the line of initial application of the coolant relaltive to the line where the molten metal initially comes into contact with said belt for creating a narrow cool section in the belt extending transversely of the belt, said narrow cool section extending transversely of the belt being located immediately preceding the line where the molten metal initially comes into contact with the belt and following said pre-heating of the belt.

5. The method of casting molten metal in a casting region defined between opposed portions of a pair of revolving endless flexible casting belts each made of relatively thin sheet metal as claimed in claim 4, in which:

the line of initial application of the coolant to the reverse surface of said pre-heated belt is arranged to be no more than one-half inch before the line where the molten metal initially comes into contact with the front face of said belt.

6. The method of casting molten metal as claimed in claim 4, including the steps of:

controlling said elevation of the belt temperature in advance of the casting region, and controlling the size of said narrow transverse cool section with respect to the elevated temperature of the belt ahead of said narrow transverse cool section and with respect to the operating temperatures of the belt after the molten metal is brought into contact with the belt, for producing a transverse stretching of the metal of the belt in said narrow transverse cool section due to thermal expansion of the belt immediately preceding and following said narrow transverse cool section.

7. The method of casting molten metal in a casting region defined between opposed portions of a pair of revolving endless flexible casting belts wherein the molten metal is brought into contact with the front faces of the casting belts and is carried along between the front faces of the belts in the casting region while liqiud coolant is applied to the reverse surfaces of the belts to remove heat from the molten metal, comprising the steps of:

applying intensive heating to the respective belt ahead of the position where the molten metal is brought into contact with the belt for pre-heating the belt, and applying hot liquid to the reverse surfaces of the edge portions of the belt on opposite sides of the casting region for maintaining the edge portions at elevated temperatures.

8. The method of casting molten metal in a casting region defined between opposed portions of a pair of revolving endless flexible metal casting belts wherein the molten metals is introduced into the casting region and is carried downstream through the casting region by the moving belts while the metal is solidifying, comprising the steps of:

elevating the temperature of the main central portion of at least one of said metal casting belts before the main central portion of said belt encounters the molten metal in the casting region, and elevating the temperature of the two edge portions of said metal belt to higher temperature levels than said main central portion before said two edge portions pass adjacent to the casting region, said two edge portions being elevated to temperature levels at least as great as the mean temperature level of the main central portion of the metal belt in the casting region.

9. The method of casting molten metal in a casting region defined between opposed portions of a pair of endless flexible casting belts wherein the molten metal is introduced at an entrance to the casting region and thereafter the molten metal travels downstream from the entrance while solidifying between the front faces of the two casting belts and wherein the heat from the solidifying molten metal is withdrawn by applying liquid coolant to the reverse surfaces of the two casting belts, comprising the steps of:

directing intensive radiant heat energy onto the front faces of the respective revolving casting belts for elevating their temperature before the respective casting belts reach the entrance to the casting region, and controlling the application of the liquid coolant to the reverse surfaces of the respective casting belts for initially applying the coolant to the reverse surfaces of the belts only a small distance from the position where the molten metal initially comes into contact with the front face of the respective casting belt.

10. The method of casting molten metal in a casting region defined between opposed portions of a pair of endless flexible casting belts, as claimed in claim 9, in which:

the application of the liquid coolant is controlled for initially applying the coolant to the reverse surfaces of the respective casting belt within a range from a small distance before to a small distance after the position where the molten metal initially come into contact with the front face of the respective casting belts.

11. The method of casting molten metal in a casting region defined between opposed portions of a pair of endless flexible casting belts, as claimed in claim 10, in which:

the application of the liquid coolant is controlled by masking off the coolant from the reverse surfaces of the respective casting belts for sharply defining the line of initial contact of the coolant with the reverse surfaces of the respective casting belts.

12. The method of casting molten metal in a casting region defined between opposed portions of a pair of revolving endless flexible casting belts wherein the belts are curved partially around respective nip rolls with the reverse surfaces of the belts engaging the nip rolls and thereafter the belts travel downstream from the nip rolls with portions of the belts travelling in spaced opposed relationship defining the casting region between their front faces and molten metal is adjacent to the front face of the opposed portions of the casting belts in the casting region, comprising the steps of:

applying intensive radiant heat energy to the front faces of the two casting belts as they move toward the nip rolls for elevating the temperatures of the belts before they reach the nip rolls, and applying further intensive radiant energy to the front faces of the two casting belts as they curve around the nip roll.

13. The method of casting molten metal in a casting region defined between opposed portions of a pair of revolving endless flexible casting belts wherein the belts are curved partially around respective nip rolls with the reverse surfaces of the belts enging the nip rolls in which there are deep grooves in the nip rolls positioned adjacent to the reverse surfaces of the casting belts as they curve around the respective nip rolls and thereafter the belts travel downstram from the nip rolls with portions of the belts travelling in spaced opposed relationship defining the casting region between their front faces and molten metal is adjacent to the front faces of the opposed portions of the casting belts in the casting region, comprising the steps of:

heating the two casting belts as they move toward the nip rolls; and injecting hot fluid into the deep grooves of the nip rolls beneath the reverse surfaces of the casting belts for continuing the heating of the two casting belts as they curve around the respective nip rolls.

14. The method of casting molten metal in a casting region defined between opposed portions of a pair of endless flexible casting belts wherein the molten metal is introduced at an entrance to the casting region and thereafter the molten metal travels downstream from the entrance while solidifying between the front faces of the two casting belts and wherein the heat from the solidifying molten metal is withdrawn by applying liquid coolant to the reverse surfaces of the two casting belts, comprising the steps of:

heating a first zone of at least one of the revolving casting belts before the respective casting belt reaches the entrance to the casting region to a mean temperature at least equal to the mean temperature of the portion of the casting belt defining the casting region, said first zone spanning transversely across the main central portion of the belt for a width equal to the width of the casting region, and heating second and third zones of said revolving casting belt before the respective casting belt reaches the entrance to the casting region to a mean temperature different from the mean temperature of said first zone, said second and third zones spanning transversely across the respective edge portions of each belt which will travel outside of the casting region as they travel along near the casting region.

15. The method of continuously casting molten metal using a pair of revolving endless flexible casting belts of metal whose front metal faces are coated with insulative coating material wherein portions of the belts travel along in spaced relationship for defining a casting region between their coated front faces for casting molten metal in the casting region and wherein the reverse surfaces of the belts near the casting region are cooled with liquid coolant, including the steps of:

directing intensive radiant heat energy onto the insulative coating material of the respective revolving casting belts before their arrival at the casting region for elevating the mean temperatures of the casting belts ahead of the casting region to levels above their mean temperatures in the casting region, and initially applyling liquid coolant to the reverse surfaces of the belts only a small distance from the position where the molten metal initially comes into contact with their coated front faces for minimizing the cooling effect of the applied coolant upon the mean temperature of the respective casting belts.

16. The method of continuously casting molten metal using a pair of revolving endless flexible casting belts of metal whose front faces are coated with insulative coating material as claimed in clalm 15;

wherein the belts are curved partially around respective nip rolls with the reverse surfaces of the belts engaging the nip rolls ahead of the casting region, including the step of:

insulating the portions of the nip rolls engaged by the reverse surfaces of the belts for minimizing the transmission of heat from the reverse surfaces of the belts into the nip rolls.

17. The method of continuously casting molten metal using a pair of revolving endless flexible casting belts of metal whose front metal faces are coated with insulative coating material wherein portions of the belts travel along in spaced relationship for defining a casting region between their coated front faces for casting molten metal in the casting region and wherein the reverse surfaces of the belts near the casting region are cooled with liquid coolant, including the steps of:

directing intensive radiant heat energy onto the insulative coating material of the respective revolving casting belts before their arrival at the casting region for elevating the temperatures of the interfaces between the metal front faces and the insulative coating material of the respective belts to levels ahead of the casting region which are equal to the temperature levels occurring at these interfaces after the molten metal has come into contact with their coated front faces, and initially applying liquid coolant to the reverse surfaces of the belts only a small distance from the position where the molten metal initially comes into contact with their coated front faces for minimizing the cooling effect of the applied coolant upon the temperature levels of these interfaces in the respective casting belts.

* * * * *